United States Patent [19]

Cocca

[11] Patent Number: 4,768,720

[45] Date of Patent: Sep. 6, 1988

[54] FUEL INJECTION

[75] Inventor: Joseph D. Cocca, Rochester, N.Y.

[73] Assignee: General Motors Corporation, Detroit, Mich.

[21] Appl. No.: 80,740

[22] Filed: Aug. 3, 1987

[51] Int. Cl.[4] ..... F02M 61/04; B05B 1/32

[52] U.S. Cl. ..... 239/533.11; 239/541; 239/584; 137/533

[58] Field of Search ..... 137/533, 528, 534, 516.25, 137/535; 239/533.11, 541, 584, 585

[56] References Cited

U.S. PATENT DOCUMENTS 1,657,741 1/1928 Carrey ..... 137/533

FOREIGN PATENT DOCUMENTS 2175952 12/1986 United Kingdom .

*Primary Examiner*—Andres Kashnikow
*Assistant Examiner*—Karen B. Merritt
*Attorney, Agent, or Firm*—C. K. Veenstra

[57] ABSTRACT

A fuel injector includes a solenoid operated valve that is opened on a periodic basis to meter fuel through a plurality of discharge passages, and also includes a rectifier valve that allows air to flow through the discharge passages when the solenoid operated valve is closed. The rectifier valve has a disc configuration with a flat valving surface adjacent an air inlet passage and an irregular surface adjacent an air outlet passage. When the solenoid operated valve is opened to meter fuel through the discharge passages, the flat valving surface of the rectifier valve is engaged against a wall about the air inlet passage to seal the air inlet passage. When the solenoid operated valve is closed, the irregular surface of the rectifier valve is engaged against the opposite wall about the air outlet passage and allows air to flow through the air inlet passage and the air outlet passage to the injector discharge passages.

3 Claims, 3 Drawing Sheets

FUEL INJECTION

TECHNICAL FIELD

This invention relates to a fuel injection system for a multi-cylinder internal combustion engine in which a plurality of injection nozzles discharge fuel adjacent the engine inlet ports and a single injector meters the fuel to all of the injection nozzles.

SUMMARY OF THE INVENTION

The fuel injection system disclosed in U.S. patent application Ser. No. 10,296 filed Feb. 2, 1987 in the names of E. R. Stettner and D. D. Stoltman includes a single, or central, injector that meters fuel to a plurality of injection nozzles.

The central injector includes a solenoid operated valve that is opened on a periodic basis to meter fuel through a plurality of discharge passages to the injection nozzles, and also includes a rectifier valve that allows air to flow through the discharge passages when the solenoid operated valve is closed.

In a fuel injector according to this invention, the rectifier valve is enclosed in a chamber having air inlet and outlet passages opening through opposed walls, and has a disc configuration with a flat valving surface adjacent the air inlet passage and an irregular surface adjacent the air outlet passage. When the solenoid operated valve is opened to meter fuel through the discharge passages, the flat valving surface of the rectifier valve is engaged against one wall about the air inlet passage to seal the air inlet passage. When the solenoid operated valve is closed, the irregular surface of the rectifier valve is engaged against the opposite wall about the air outlet passage and allows air to flow through the air inlet passage, the chamber, and the air outlet passage to the injector discharge passages.

The details as well as other features and advantages of a preferred embodiment of this invention are set forth in the remainder of the specification and are shown in the accompanying drawings.

SUMMARY OF THE INVENTION

In FIG. 2, the line 1A—1A is the section line for the FIG. 1 view of the injector base, and the line 1B—1B is the section line for the FIG. 1 view of the air inlet adapter.

THE PREFERRED EMBODIMENT

Figure 1:
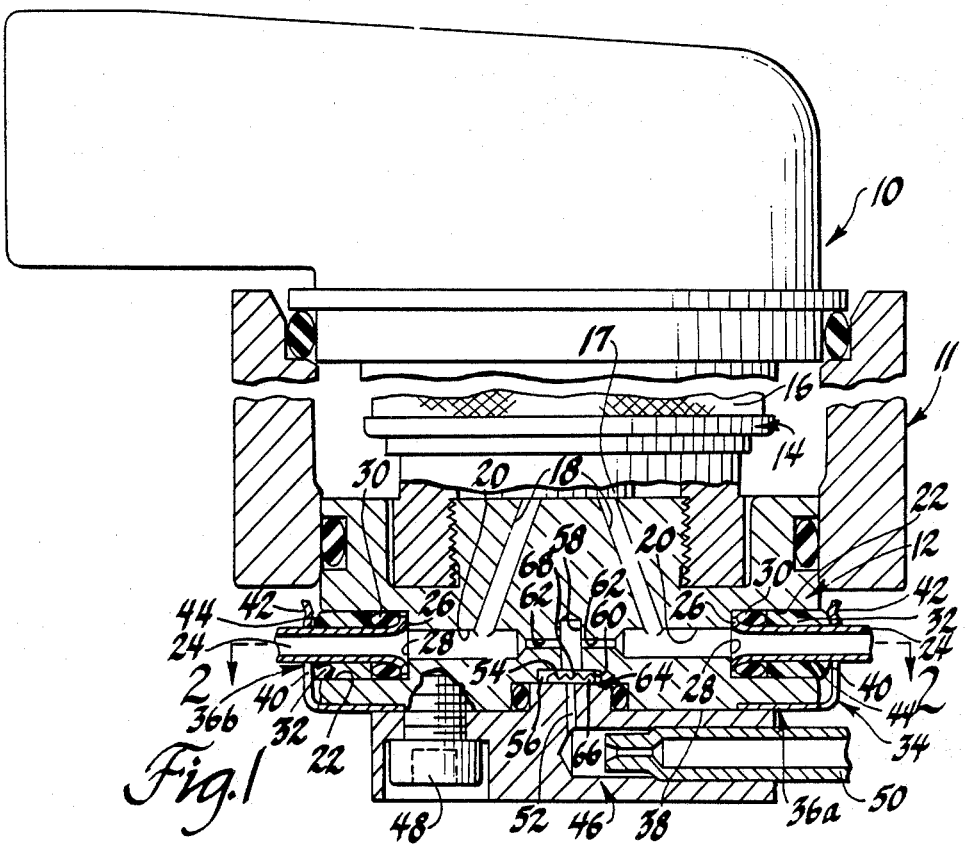
FIG. 1 is a partially sectional view of a fuel injector incorporating a preferred embodiment of this invention and showing the connection of the air outlet passage to the discharge passages.
Figure 2:
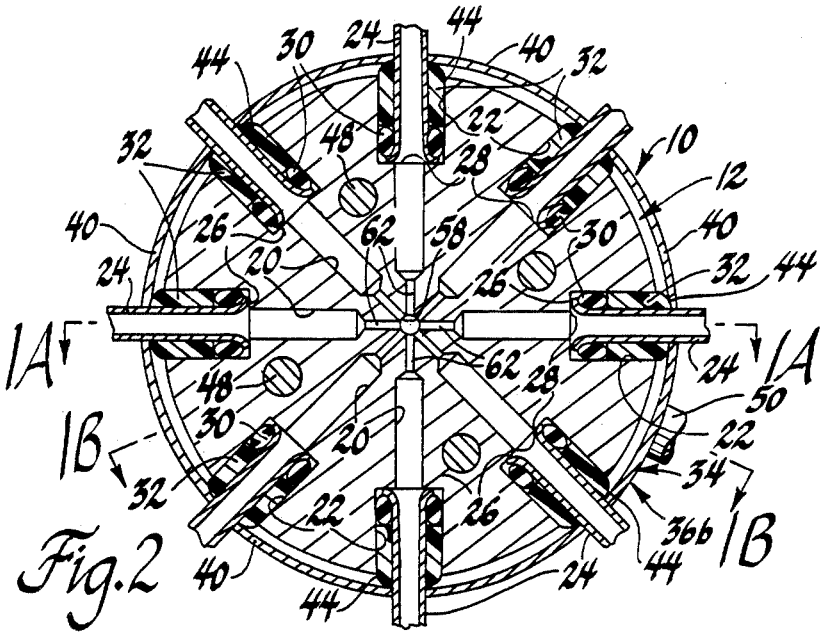
FIG. 2 is a sectional view through the lower portion of the FIG. 1 injector, taken along line 2—2 of FIG. 1, further showing the connection of the air outlet passage to the discharge passages.
Figure 3:
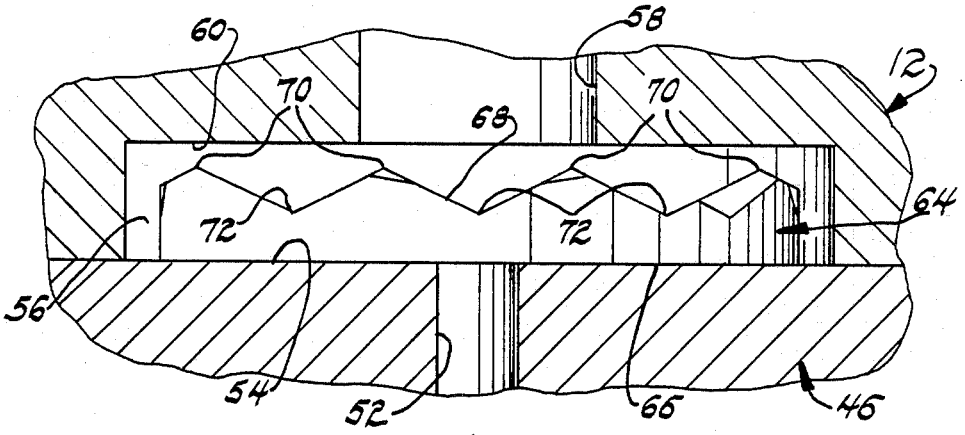
FIG. 3 is an enlarged view of the rectifier valve showing its flat valving surface engaged against the wall about the air inlet passage to seal the air inlet passage.
Figure 4:
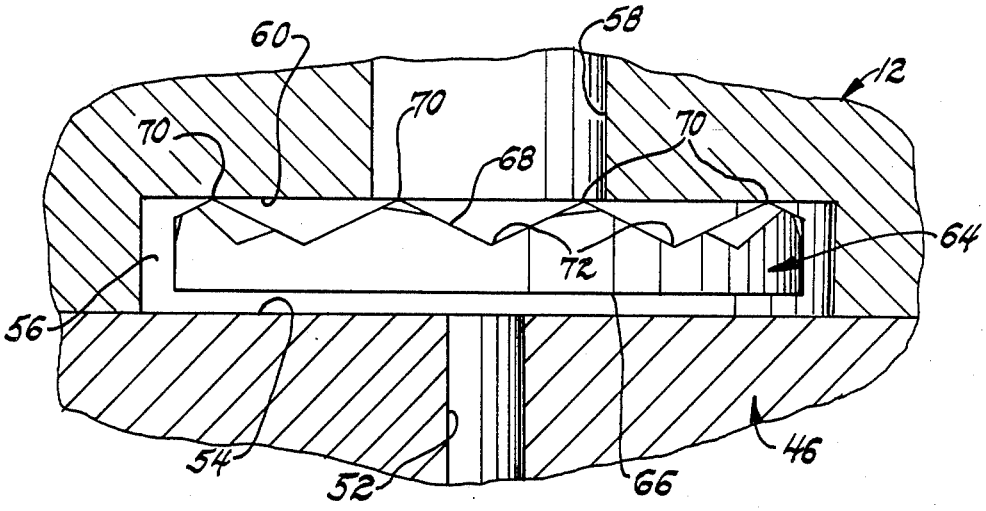
FIG. 4 is an enlarged view of the rectifier valve showing its irregular surface engaged against the wall about the air outlet passage to allow air to flow through the air inlet passage, the chamber, and the air outlet passage to the injector discharge passages.
Figure 5:
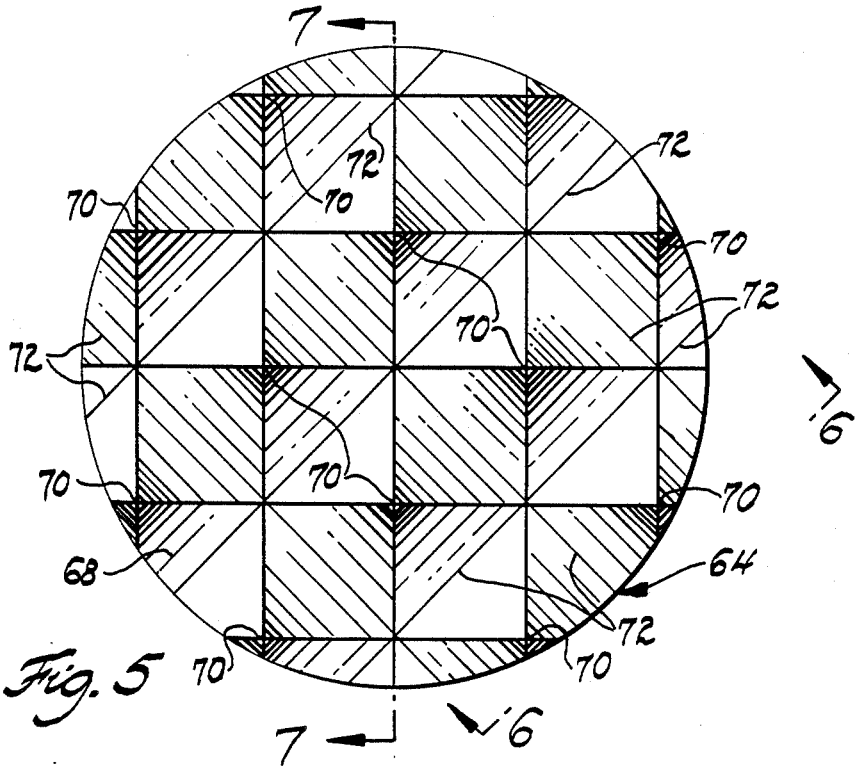
FIG. 5 is a plan view of the irregular surface of the rectifier valve showing the knurling that creates the irregular surface in this preferred embodiment.
Figure 6:
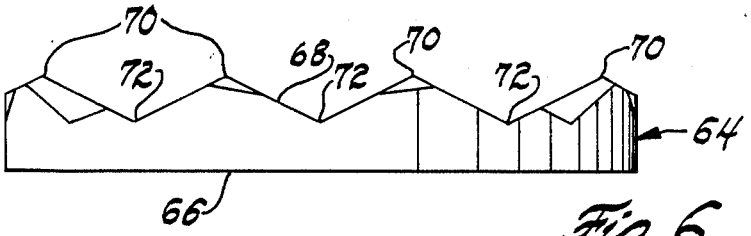
FIG. 6 is an edge view of the rectifier valve indicated by the line 6—6 of FIG. 5.
Figure 7:
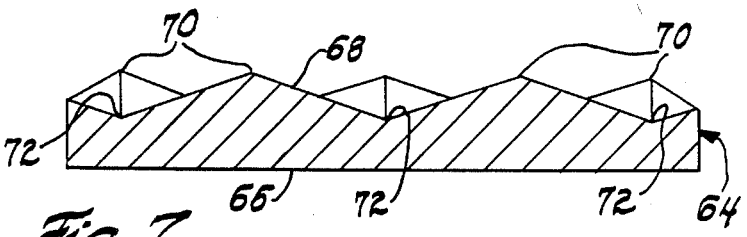
FIG. 7 is a sectional view of the rectifier valve taken along line 7—7 of FIG. 5, further showing the knurling that creates the irregular surface in this preferred embodiment.

Referring first to FIGS. 1 and 2, a fuel injector 10 is received in a fuel body 11 and has a cylindrical base 12 that is threaded into an upper portion 14. Upper portion 14 has a cylindrical filter element 16 surrounding a fuel inlet region, and a solenoid operated valve element 17 that overlies a plurality of fuel discharge passages 18 formed in base 12. Each discharge passage 18 extends through a radially directed feed passage 20 to a radially opening recess 22 that receives an injection tube 24.

The end 26 of each injection tube 24 is flared and received in a stepped region 28 at the intersection of its recess 22 and its feed passage 20. Each injection tube 24 is surrounded by an O-ring 30 that seals the tube 24 in its recess 22. Each injection tube 24 is further surrounded by a plastic sleeve 32 that supports the tube 24 in its recess 22.

A retainer clip 34 has a base portion **36*a* that underlies the bottom 38 of injector base 12, and a cylindrical portion 36*b* divided into spring fingers 40 that embrace injection tubes 24. As retainer clip 34 is pressed onto injector base 12, the curled upper end 42 of each spring finger 40 flexes outwardly to lead over the rounded ends 44 of injection tube sleeves 32. The spring fingers 40 then bias injection tube sleeves 32 to retain the ends 26 of injection tubes 24 in their recesses 22, while the rounded ends 44 of sleeves 32 assist in holding retainer clip 34 on injector base 12. This structure thereby assures that injection tubes 24 may be readily connected to and retained by injector 10**.

An air inlet adapter 46 is secured by bolts 48 to the bottom 38 of injector base 12 and also assists in holding retainer clip 34 on injector base 12. Air inlet adapter 46 has an inlet tube 50 that leads clean air to an air inlet passage 52. Inlet passage 52 opens through the bottom wall 54 of a rectifier valve chamber 56 defined between injector base 12 and adapter 46. An air outlet passage 58 opens through the top wall 60 of chamber 56 and extends to a plurality of air discharge passages 62, each opening radially into a feed passage 20.

A rectifier valve disc 64 is enclosed in chamber 56 and has a flat valving surface 66 adjacent air inlet passage 52 and an irregular surface 68 adjacent air outlet passage 58. When the solenoid operated valve element 17 is opened to meter fuel through discharge passages 18, the pressure in feed passages 20 and air passages 62 and 58 increases to engage the flat valving surface 66 of rectifier valve 64 against the bottom wall 54 of chamber 56 about air inlet passage 52, thereby sealing air inlet passage 52. When solenoid operated valve element 17 is closed, the reduced pressure in feed passages 20 and air passages 62 and 58 lifts the rectifier valve 64; the irregular surface 68 of rectifier valve 64 engages the upper wall 60 about air outlet passage 58 and allows air to flow through air inlet passage 52, chamber 56, air outlet passage 58 and air discharge passages 62 to discharge feed passages 20.

Further details of the construction and operation of injector 10 are set forth in U.S. patent application Ser. No. 10,296 mentioned above, and other such details are set forth in U.S. Pat. No. 4,572,436 issued Feb. 25, 1986 in the names of K. P. Cianfichi, E. R. Stettner and D. D. Stoltman. Those details will not be repeated here.

As shown in FIGS. 3 through 7, the irregular surface 68 of rectifier valve 64 is formed by knurled peaks 70 and valleys 72. When rectifier valve 64 is lifted, peaks 70 engage upper wall 60 and air flows from chamber 56 through valleys 72 to air outlet passage 58, air discharge passages 62 and discharge feed passages 20.

Clearly it is important, during manufacture of injector 10, that rectifier valve 64 be installed in chamber 56 with the irregular surface 68 adjacent upper wall 60. This may be accomplished by employing a suction tube to pick the rectifier valves 64 from a bin or other source of valves and place them in chamber 56. The suction tube will be effective to pick a rectifier valve 64 out of the bin only if the suction tube engages the flat valving surface 66 of a rectifier valve 64, and accordingly can only install the rectifier valve 64 in chamber 56 with the irregular surface 68 adjacent upper wall 60.

Injector 10 also employs the invention set forth in patent application Ser. No. 07/080,831 filed concurrently.

The embodiments of the invention in which an exclusive property or privilege is claimed are defined as follows:

1. A fuel injector having a discharge passage, a rectifier valve chamber with opposed walls, an air inlet passage opening though one of said walls into said chamber, and an air outlet passage opening through the other of said walls from said chamber to said passage, said injector being adapted to meter fuel on a periodic basis through said discharge passage, said injector including a rectifier valve disposed in said chamber, said rectifier valve having a disc configuration with a flat valving surface adjacent said air inlet passage and an irregular surface adjacent said air outlet passage, said flat valving surface of said rectifier valve engaging said one wall about said air inlet passage to seal said air inlet passage in response to pressures created when fuel is metered through said discharge passage, said irregular surface of said rectifier valve engaging said other wall about said air outlet passage to allow air to flow through said air inlet passage, said chamber and said air outlet passage to said discharge passage in response to pressures created when fuel is not metered through said discharge passage.

2. The fuel injector of claim 1 wherein said irregular surface of said rectifier valve is formed by knurled peaks and valleys.

3. The method of assembling the fuel injector of claim 1, said method comprising the step of employing a suction tube to pick said rectifier valve from a source of valves and place said rectifier valve in said chamber, said suction tube being effective to pick said rectifier valve from said source only if said suction tube engages said flat valving surface of said rectifier valve and accordingly being effective to install said rectifier valve in said chamber only with said irregular surface adjacent said air outlet passage.

* * * * *